US007343286B2

(12) United States Patent
Huang

(10) Patent No.: US 7,343,286 B2
(45) Date of Patent: Mar. 11, 2008

(54) METHOD AND APPARATUS FOR DIGITAL SIGNAL PROCESSING

(75) Inventor: Chun-Jieh Huang, Changhua (TW)

(73) Assignee: Sonix Technology Co., Ltd., Chupei, Hsinchu (TW)

( * ) Notice: Subject to any disclaimer, the term of this patent is extended or adjusted under 35 U.S.C. 154(b) by 1003 days.

(21) Appl. No.: 10/636,460

(22) Filed: Aug. 6, 2003

(65) Prior Publication Data

US 2004/0254789 A1 Dec. 16, 2004

(51) Int. Cl.
*G10L 21/00* (2006.01)

(52) U.S. Cl. ..... 704/229; 704/500; 704/501; 704/502; 704/503; 704/504

(58) Field of Classification Search ..... 704/229, 704/500, 501, 502, 503, 504; 341/156; 340/347
See application file for complete search history.

(56) References Cited

U.S. PATENT DOCUMENTS 4,855,745 A * 8/1989 Smither ..... 341/156

* cited by examiner

*Primary Examiner*—Richemond Dorvil
*Assistant Examiner*—Natalie Lennox
(74) *Attorney, Agent, or Firm*—Michael A. Glenn; Glenn Patent Group

(57) ABSTRACT

A method and an apparatus analogically output low-resolution digital signals to achieve an equal analog output result of a high-resolution digital signal under a request of signal quality. The low-resolution digital signals are compensatively output multiple times to gain the energy thereof equal to the energy output by the high-resolution digital signal. Therefore, a digital-to-analog conversion with fewer bits satisfies a higher demand for accuracy generally achieved by a digital-to-analog conversion with more bits.

11 Claims, 3 Drawing Sheets

METHOD AND APPARATUS FOR DIGITAL SIGNAL PROCESSING

BACKGROUND OF THE INVENTION

1. Field of Invention

The present invention relates to a method and an apparatus for digital signal processing and more particularly to a method and an apparatus for utilizing low-resolution digital signals to get the same output result as high-resolution digital signals.

2. Description of Related Art

Sound and light both are waves. There are two ways to store these analog signals; one way is analog storage, and the other way is digital storage. For example, a conventional analog storage medium for audio signals uses magnetic characteristics of a storage media to record directly the audio signals. These storage media, such as disks, tapes, and videotapes, are easily distributed, but the frequencies recorded by them are limited and are easily distorted by damage. These storage media thus can be used for only a short time. A digital storage medium uses digital signals composed of binary digits 0 and 1 to record the audio signals, examples thereof being compact discs, digital compact cassettes, digital audio tapes, and hard disks. The audio signals stored by these digital storage media are preserved well and the reproduction quality thereof is also better.

The audio signals stored by the digital storage are stored as digital signals, but audio signals in nature are transferred in analog signal form. If the audio signals are stored in digital signal form, the first step in the process is to convert the analog audio signals to the digital signals. The conversion is called an analog-to-digital conversion. The analog-to-digital conversion first samples the analog signals. Taking audio signals as an example, the sampling of the audio signals has two main factors: sampling rate and sampling resolution.

Sampling is how analog information is digitized. Digitization is performed by sampling at discrete intervals. To digitize sound, for example, a device measures amplitudes of sound waveforms many times per second. These numeric values can then be recorded digitally. The sampling rate is therefore defined as a frequency of sampling the waveform of the audio signals per second. When the sampling rate of the audio signal is higher, the sound quality output by the recorded digital signals is clearer, but the data size thereof is larger. In addition, the sound quality output by the digital signals only can achieve a result of a half of the actual sampling rate, and a double sampling rate is therefore used to reproduce original sound precisely. For example, the hearing limitation of humans is about 20 KHz, so the sampling rate for the preferred sound quality should be more than 40 KHz.

The sampling resolution determines whether the sampled audio signals preserve the original waveforms well. If the sampling resolution is higher, the waveforms reproduced from the sampled digital signals are closer to those of the original audio signals. If the sampling is carried out at the 8-bit rate, a quantity of combinations it can represent is $2^8$, i.e. 256. That means an 8-bit resolution is only able to differentiate 256 levels of sound. If the sampling is carried out at a 16-bit rate, a quantity of combinations it can represent is $2^{16}$, i.e. 65536, and the accuracy of the sampling is naturally improved.

According the foregoing two main factors of the sampling of the audio signals, sampling rate and sampling resolution, common digital audio signals, such as CD-quality audio signals, radio-quality audio signals, and telephone audio signals, are listed in Table. 1 to compare differences therebetween.

TABLE 1

Common digital audio signals.

| Sound Type | Sampling Rate | Sampling Resolution | Channels | Amount of Data per Second |
|---|---|---|---|---|
| CD-quality | 44,100 | 16 bits | Stereo | 44,100*16*2 = 1,411,200 bits |
| Radio-quality | 22,050 | 8 bits | Mono | 22,050*8*1 = 176,400 bits |
| Telephone-quality | 11,025 | 8 bits | Mono | 11,025*8*1 = 88,200 bits |

Form the Table. 1, the specification, such as sampling rate, sampling resolution and channels, of the CD-quality audio signals is superior to those of the radio-quality audio signals and the telephone-quality audio signals. The sound quality of the audio signals stored in CD-quality is clearer and more precise, but the amount of data per second thereof is further larger than for the others, and a larger storage space is therefore needed to store the CD-quality audio signals.

When the foregoing digital audio signals are output, for example, the foregoing audio signal stored in the compact discs or the hard disks are output by a speaker, the digital audio signals need to be converted back to the original analog audio signal for outputting, and the conversion step is called a digital-to-analog conversion (DAC).

When the digital-to-analog conversion is performed, if the sampling resolution thereof is higher, i.e. there are more sampling bits, the cost of the conversion circuit is higher as well. For example, the amount of circuit mirrors utilized in an 8-bit conversion circuit is only a quarter of the amount of circuit mirrors utilized in a 10-bit conversion circuit, and every circuit mirror occupies a particular unit area. In other words, the layout of the 10-bit conversion circuit is larger than the layout of the 8-bit conversion circuit by 768 unit areas, so the manufacturing cost of the 10-bit conversion circuit is substantially raised. For a manufacturer, the high-resolution digital-to-analog conversion, conversion with more bits, is thus a big burden on manufacturing cost thereof.

SUMMARY OF THE INVENTION

It is therefore an objective of the present invention to provide a method and an apparatus for digital signal processing that satisfies the need to use low-resolution digital signals to achieve the analog output result of a high-resolution digital signal.

It is another an objective of the present invention to provide an apparatus for digital signal processing to reduce the manufacturing cost of the high-resolution digital-to-analog conversion circuit.

It is still another an objective of the present invention to provide a compensative method for digital signal processing. A low-resolution digital-to-analog conversion is used to output analog signals with high-resolution.

In accordance with the foregoing and other objectives of the present invention, a method and an apparatus for digital signal processing is described. The invention analogically outputs low-resolution digital signals to achieve the analog output result of a high-resolution digital signal under a request of signal quality. The method and apparatus of the invention compensatively output the low-resolution digital signals multiple times to accumulate an energy thereof equal to the energy output by the high-resolution digital signal. Therefore, a digital-to-analog conversion with fewer bits satisfies a higher demand for the level of accuracy generally achieved by a digital-to-analog conversion with more bits.

When the forgoing high-resolution digital signal is m-bit and the foregoing low-resolution digital signal is n-bit, the invention first divides the m-bit high-resolution digital signal into an n-bit most significant bits number and an (m−n)-bit least significant bits number, with a value of the (m−n)-bit least significant bits number equal to B. Then an output time period of the digital-to-analog is divided into $2^{(m-n)}$ equal parts, namely time frames. During outputting, a value of the n-bit most significant bits number is output in the $2^{(m-n)}$-B time frames of the output time period, and another value of one plus the most significant bits number is output in the remaining B time frames of the output time period. Thus outputting the n-bit low-resolution digital signal achieves an analog output result equal to that of the m-bit high-resolution digital signal.

In one preferred embodiments of the present inventions, the invention first outputs value A in the former $2^{(m-n)}$-B time frames of the output time period, after finishing the outputting of value A, then outputs value (A+1) in the later remaining time frames of the output time period. The high-resolution digital signals are audio signals, and are stored in a digital signal storage medium, such as a compact disc or a hard disk, which cooperates with a processing unit to read digital signals thereof. An output unit such as, for example, a speaker or an amplifier, receives the analog signals output by the low-resolution digital signals and emits sound.

In conclusion, the invention substantially decreases the manufacturing cost by using low-resolution digital-to-analog conversion instead of the original high-resolution digital-to-analog conversion. Moreover, the clocks of the operations of the modern processing units are very high, and the invention therefore does not cause excessive loading during data processing. So the invention provides an economical and practical method and apparatus for digital signal processing.

It is to be understood that both the foregoing general description and the following detailed description are examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
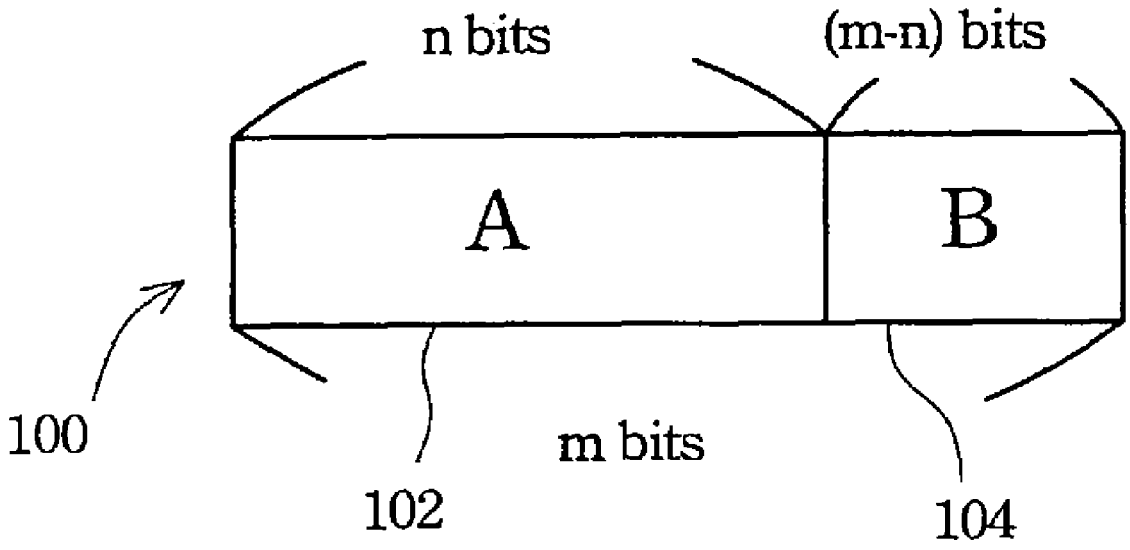
FIG. 1 is a schematic view of one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

The present invention provides a method and an apparatus for digital signal processing, using low-resolution digital signals to achieve the analog output result of a high-resolution digital signal to reduce the high manufacturing cost of the conventional high-resolution conversion circuit.

The invention analogically outputs low-resolution digital signals to achieve the analog output result of a high-resolution digital signal under a request of signal quality. The method and apparatus of the invention compensatively output the low-resolution digital signals multiple times to gain an energy thereof equal to the energy output by the high-resolution digital signal. Therefore, a digital-to-analog conversion with fewer bits satisfies a higher demand for accuracy generally achieved by a digital-to-analog conversion with more bits.

When the forgoing high-resolution digital signal is m-bit and the foregoing low-resolution digital signal is n-bit, the invention first divides the m-bit high-resolution digital signal into an n-bit most significant bits number and a (m−n)-bit least significant bits number, and a value of the (m−n)-bit least significant bits number is B. Then an output time period of the digital-to-analog is divided into $2^{(m-n)}$ equal parts, namely time frames. During outputting, a value of the n-bit most significant bits number is output in the $2^{(m-n)}$-B time frames of the output time period, and another value of one plus the most significant bits number is output in the remaining B time frames of the output time period. Thus outputting the n-bit low-resolution digital signal achieves an analog output result equal to that of the m-bit high-resolution digital signal.

From the foregoing description, when the n-bit low-resolution digital signal is output to achieve the analog output result equivalent to that of the m-bit high-resolution digital signal, the output frequency of the low-resolution digital signal is $2^{(m-n)}$ times the output frequency of the high-resolution digital signal. For example, if the invention uses an 8-bit digital signal to achieve an analog output result of a 10-bit digital signal, the output frequency of the 8-bit digital signal is four times the output frequency of the 10-bit digital signal.

The hearing limitation of humans is about 20 KHz. If the sampling rate is set at 20 KHz, and an 8-bit digital signal is used to achieve an analog output result of a 10-bit digital signal, the output frequency of the 8-bit digital signal is multiplied by four to be about 100 KHz by utilizing the invention. For modern processing units whose operating clocks generally are mega Hz, this output frequency, 100 KHz is not a big load. The invention can therefore apply common processing units to output the low-resolution digital signal multiple times and achieve an analog output result equal to that of a high-resolution digital signal. Using the high-clock operations of modern processing units consequently saves the manufacturing cost of the digital-to-analog conversion circuits.

FIG. 1 is a schematic view of one preferred embodiment of the invention. A high-resolution digital signal 100 has m bits, and n most significant bits thereof are defined as a most significant bits number 102. The (m−n) least significant bits thereof are defined as a least significant bits number 104. A value of the high-resolution digital signal 100 is X, a value of the most significant bits number 102 is A, and a value of the least significant bits number 104 is B.

The numerical relation between the high-resolution digital signal 100, the most significant bits number 102 and the least significant bits number 104 is represented by the following equation (1) as:

$$X=A\cdot 2^{m-n}+B \tag{1}$$

The method of the invention outputs value A of the most significant bits number 102 by $2^{(m-n)}$-B times, and outputs the other value (A+1) of one plus the most significant bits number 102 by B times. A sum of these two values is represented by the following equation (2) as:

$$X'=A\cdot(2^{m-n}-B)+(A+1)\cdot B \tag{2}$$

After rearrangement, equation (1) is equal to equation (2) as follows:

$$\begin{aligned} X &= A\cdot 2^{m-n}+B \\ &= A\cdot(2^{m-n}-B)+A\cdot B+B \\ &= A\cdot(2^{m-n}-B)+(A+1)\cdot B \\ &= X' \end{aligned}$$

Therefore, the invention separately and repeatedly outputs value A of the low-resolution most significant bits number 102 and value (A+1) to achieve a substantially equal analog output result of the high-resolution digital signal 100.

The following description has some examples, which interpret more clearly that the value obtained by the invention is really equal to the value of the high-resolution digital signal.

The sum of the multiple of A and (A+1) of the low-resolution digital signal is:

$$\begin{aligned} &= (2^{-(m-n)})\times[(2^{(m-n)}-B)\times\langle A,0\rangle+(B)\times\langle A+1,0\rangle] \\ &= (2^{-(m-n)})\times[(2^{(m-n)}-B)\times\langle A,0\rangle+(B)\times\langle A,0\rangle+(B)\times\langle 1,0\rangle] \\ &= (2^{-(m-n)})\times[(2^{(m-n)})\times\langle A,0\rangle+(B)\times\langle 1,0\rangle] \\ &= (2^{-(m-n)})\times[(2^{(m-n)})\times\langle A,0\rangle+\langle B,0\rangle] \\ &= (2^{-(m-n)})\times[(2^{(m-n)})\times\langle A,0\rangle+\langle B,0\rangle] \\ &= \langle A,0\rangle+(2^{-(m-n)})\times\langle B,0\rangle \\ &= \langle A,0\rangle+\langle 0,B\rangle \\ &= \langle A,B\rangle \\ &= \text{The value of the high-resolution digital signal} \end{aligned}$$

<A+1, 0> represents the value of one plus the low-resolution digital signal, so it can be separated into:

$$\langle A+1,0\rangle=\langle A,0\rangle+\langle 1,0\rangle$$

Figure 2:
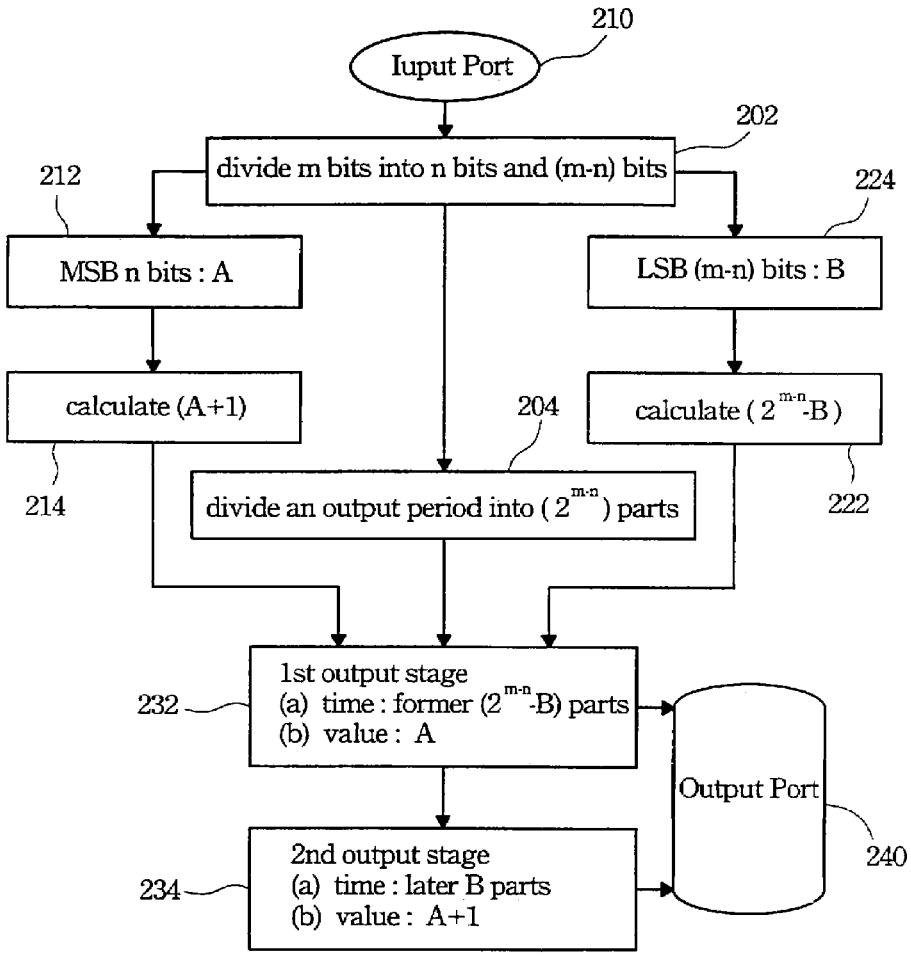
FIG. 2 is a flow chart according to one preferred embodiment of the method of this invention.

FIG. 2 illustrates a flow chart of one preferred embodiment of the method of the invention, and the following description refers to FIG. 1 and FIG. 2, simultaneously. First, the m-bit high-resolution digital signal 100 is inputted from an input port 210. And in step 202, the high-resolution digital signal 100 is divided into two parts; one part is the most significant bits number 102, and the other part is the least significant bits number 104.

Subsequently, in one aspect, the method calculates the output values. In step 212, the value of the most significant bits number 102 is calculated as A, and then in step 214, value (A+1) is also calculated. The values A and (A+1) are used as the values of the output analog signal. In another aspect, the method calculates the output times. In step 224, the value of the least significant bits number 104 is calculated as B, and then in step 222, the value $2^{(m-n)}$-B is calculated. Value B and $2^{(m-n)}$-B are used to be the quantities of the output times.

Moreover, in step 204, the output time period of the digital-to-analog is divided into $2^{(m-n)}$ equal time frames. Afterward, the foregoing values A and (A+1) of the output analog signal, the quantities B and $2^{(m-n)}$-B of output times, and the divisional parts $2^{(m-n)}$ of the output time period are used together to process steps 232 and 234. At the first output stage (as illustrated in step 232), value A is output to an output port 240 in the former $2^{(m-n)}$-B time frames of the output time period. At the second output stage (as illustrated in step 234), value (A+1) is output to the output port 240 in the later B time frames of the output time period.

It is noted that this embodiment of the invention first outputs value A in the former $2^{(m-n)}$-B time frames of the output time period, after finishing the outputting of value A, and then outputs value (A+1) in the later B time frames of the output time period. However, the invention is not limited to the output sequence of the values A and (A+1); in other words, the invention also can first output value (A+1) in the former B time frames of the output time period, and then output value A in the later $2^{(m-n)}$-B time frames of the output time period in actual practices. Further, in other applications, the values A and (A+1) are output in random sequence. As long as value A is output in $2^{(m-n)}$-B time frames and value (A+1) is output in B time frames during the whole output time period, the application falls within the scope and spirit of the invention.

Furthermore, the steps illustrated in FIG. 2 are for clear interpretation of the method of the invention; however, some steps thereof can be combined with other steps or be separated into other additional steps. For instance, step 212 and step 214 can be combined into a single step. Step 224 and step 222, or step 232 and step 234, can be combined into a single step as well. Alternatively, step 222 can be separated into two steps, calculating the values of $2^{(m-n)}$ and B separately, and then subtracting B from $2^{(m-n)}$ to get the same result as step 222. So the steps illustrated in FIG. 2 are only used to interpret the method of the invention, and do not limit any other embodiment of the invention.

From the foregoing description, two simple examples are provided as following to explain the actual practices of the invention.

EXAMPLE 1

A 12-bit high-resolution digital signal 110110110111 is analogically output by the method of the invention with a low-resolution digital signal:

a. When the 12-bit high-resolution digital signal is output with an 8-bit low-resolution digital signal, the most significant bits number is 11011011 and the least significant bits number is 0111 so m−n=4, B=7 and A=219.

b. When the 12-bit high-resolution digital signal is output with a 9-bit low-resolution digital signal the most significant bits number is 110110110 and the least significant bits number is 111 so m−n=3, B=7 and A=438.

EXAMPLE 2

A 10-bit high-resolution digital signal 1010101101 is analogically output by the method of the invention with an 8-bit low-resolution digital signal:

Value X of 1010101101 is 685, the most significant bits number is 10101011, and value A is 171. The least significant bits number is 01, and value B is 1 and $2^{(10-8)}=4$. Accumulating value A three times and value (A+1) one time thus obtains the same value X of the original high-resolution digital signal:

$$X'=171*3+172*1=X$$

Figure 3:
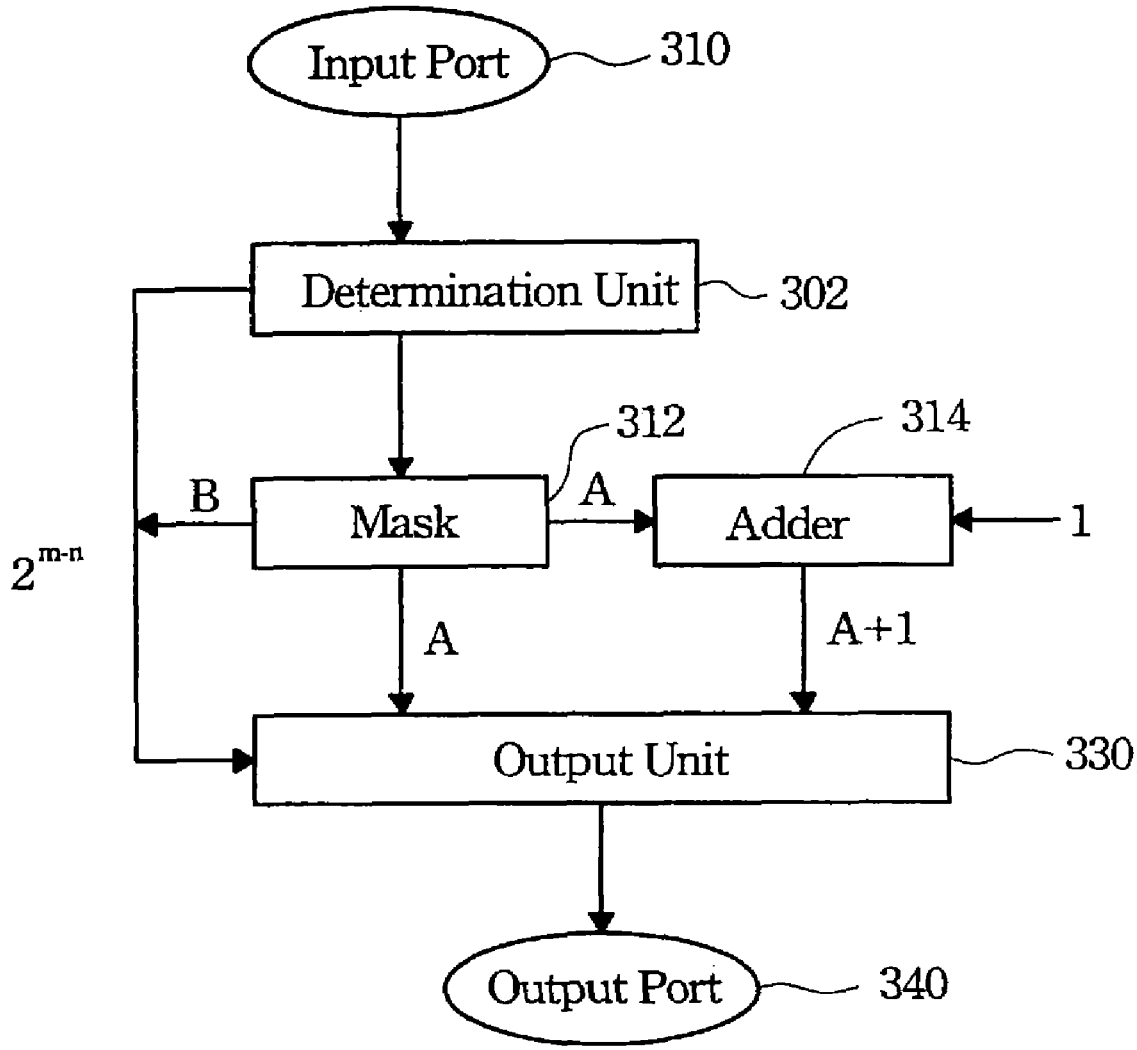
FIG. 3 is a schematic view according to one preferred embodiment of the apparatus of this invention.

FIG. 3 is a schematic view of another preferred embodiment of the invention, and illustrates an apparatus for digital signal processing. The following explanation refers to FIGS. 1-3. First, the high-resolution digital signal 100 is input from an input port 310. Then the high-resolution digital signal 100 is transferred to a determination unit 302 (step 202). The determination unit 302 sends instructions to a mask 312 according to a bit quantity m of the high-resolution digital signal 100 and a bit quantity n of a low-resolution digital signal which utilized by the invention.

According to the instructions from the determination unit 302, the mask 312 conceals the (m−n)-bit least significant bits number 104 from the high-resolution digital signal 100 to leave only the n-bit most significant bits number 102, and then sends the most significant bits number 102 to an output unit 330 and an adder 314, separately (step 212). The adder 314 adds one to value A of the most significant bits number 102, and then sends it to the output unit 330 (step 214).

Moreover, the determination unit 302 further sends a quantity of the divisional parts $2^{(m-n)}$ of the output time period to the output unit 330 (step 204). The mask 312 also sends value B of the least significant bits number 104 to the output unit 330 (steps 224 and 222). According to the data received from the determination unit 302, the mask 312 and the adder 314, the output unit 330 outputs value A in the $2^{(m-n)}$-B time frames of the output time period, and outputs value (A+1) in the B time frames of the output time period (steps 232 and 234).

The input unit 310 in the FIG. 3 can be a digital signal storage media, such as a compact disc or a hard disk, and cooperates with a processing unit to read digital signals thereof. The output unit 340 can be a speaker or an amplifier, receives analog signals to give off sound. Similarly, the apparatus illustrated in FIG. 3 is only one preferred embodiment of the invention, and every portion of the preferred embodiment in FIG. 3 can be combined with other portions or be separated into other portions. The apparatus of the invention is not limited by the configuration illustrated in FIG. 3. For example, the input 310 can directly send the high-resolution digital signal to the mask 312, and not through the determination unit 302.

Besides the application of digital-to-analog conversion of audio signals, the invention is also used in applications of digital-to-analog conversions of other signals. For example, the digital-to-analog conversion of video signals or voltage signals is also compatible with the method and apparatus of the invention, can use low-resolution digital signals to achieve analog output results of high-resolution digital video or voltage signals.

The invention uses low-resolution digital signals to achieve an analog output result equal to that of high-resolution digital signals. The high-processing unit operating at high-clock is used to output the low-resolution digital signals multiple times, thus representing the analog output results equal to those of the high-resolution digital signals. In addition, the energy of the low-resolution digital signals in the invention is entirely equal to the energy of the original high-resolution digital signals. The invention is not an approximate conversion, but is rather a correct conversion.

In conclusion, the invention substantially decreases the manufacturing cost by using low-resolution digital-to-analog conversion instead of the original high-resolution digital-to-analog conversion. Moreover, the clocks of the operations of the modern processing units are very high, and the invention therefore does not cause excessive loading during data processing. The invention thus provides an economical and practical method and apparatus for digital signal processing.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A apparatus for digital signal processing, provided for transforming a high-resolution digital signal into a low-resolution digital signal and sending the low-resolution digital signal to an electronic device in a time period, the digital signal processing apparatus comprising:

a determination unit, generating instructions and a predetermined quantity according to bit quantities of the high-resolution digital signal and the low-resolution digital signal;

a mask, dividing the high-resolution digital signal into the low-resolution digital signal and a remainder according to the instructions, wherein a value of the remainder is defined as B;

an adder, receiving the low-resolution digital signal and adding one to a value of the low-resolution digital signal; and an output unit, receiving the predetermined number, the low-resolution digital signal, the value of one plus the low-resolution digital signal and the value B, dividing the time period into the predetermined quantity of time frames, sending a value of the low-resolution digital signal to the electronic device in the $(2^{(m-n)}-B)$ time frames, and sending the value of one plus the low-resolution digital signal to the electronic device in the B time frames;

wherein a result generated by the electronic device with the low-resolution digital signal is substantially equal to a result generated by the electronic device with the high-resolution digital signal.

2. The apparatus for digital signal processing of claim 1, wherein the electronic device comprises a speaker.

3. The apparatus for digital signal processing of claim 1, wherein the high-resolution digital signal and the low-resolution digital signal are audio signals.

4. The apparatus for digital signal processing of claim 1, wherein the apparatus for digital signal processing further comprises an input port, for inputting the high-resolution digital signal.

5. The apparatus for digital signal processing of claim 4, wherein the input port comprises a digital signal storage media.

6. The apparatus for digital signal processing of claim 1, wherein when a difference between the bit quantities of the high-resolution digital signal and the low-resolution digital signal is a first number, the predetermined quantity is two to a power of the first number.

7. A apparatus for digital audio signal processing, provided for transforming a high-resolution digital audio signal into a low-resolution digital audio signal and sending the low-resolution digital audio signal to an electronic device in a time period, the digital audio signal processing apparatus comprising:

a determination unit, generating instructions and a predetermined quantity according to bit quantities of the high-resolution digital audio signal and the low-resolution digital audio signal;

a mask, dividing the high-resolution digital audio signal into the low-resolution digital audio signal and a remainder according to the instructions, wherein a value of the remainder is defined as B;

an adder, receiving the low-resolution digital audio signal and adding one to a value of the low-resolution digital audio signal; and an output unit, receiving the predetermined number, the low-resolution digital audio signal, the value of one plus the low-resolution digital audio signal and value B, dividing the time period into the predetermined quantity of time frames, sending a value of the low-resolution digital audio signal to the electronic device in the $(2^{(m-n)}-B)$ time frames, and sending the value of one plus the low-resolution digital audio signal to the electronic device in the B time frames;

wherein an audio effect output by the electronic device with the low-resolution digital audio signal is substantially equal to an audio effect output by the electronic device with the high-resolution digital audio signal.

8. The apparatus for digital audio signal processing of claim 7, wherein the electronic device comprises a speaker.

9. The apparatus for digital audio signal processing of claim 7, wherein the apparatus for digital audio signal processing further comprises an input port, for inputting the high-resolution digital audio signal.

10. The apparatus for digital signal processing of claim 9, wherein the input port comprises a digital signal storage media.

11. The apparatus for digital signal processing of claim 7, wherein when a difference between the bit quantities of the high-resolution digital audio signal and the low-resolution digital audio signal is a first number, the predetermined quantity is two to a power of the first number.

* * * * *